US007302210B2

(12) United States Patent
Fukushima et al.

(10) Patent No.: US 7,302,210 B2
(45) Date of Patent: Nov. 27, 2007

(54) ELECTROPHOTOGRAPHIC PHOTORECEPTOR AND IMAGE FORMING APPARATUS HAVING THE SAME

(75) Inventors: Kotaro Fukushima, Kawanishi (JP); Hisayuki Utsumi, Nara (JP); Yohichi Takesawa, Toyonaka (JP); Shinya Mimura, Nara (JP); Tatsuhiro Morita, Kashiba (JP); Katsuya Takano, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 132 days.

(21) Appl. No.: 10/550,888

(22) PCT Filed: Mar. 31, 2004

(86) PCT No.: PCT/JP2004/004681

§ 371 (c)(1),
(2), (4) Date: Sep. 27, 2005

(87) PCT Pub. No.: WO2004/090643

PCT Pub. Date: Oct. 21, 2004

(65) Prior Publication Data

US 2006/0177238 A1 Aug. 10, 2006

(30) Foreign Application Priority Data

Apr. 4, 2003 (JP) ..... 2003-101694

(51) Int. Cl.
*G03G 15/00* (2006.01)
*G03G 21/00* (2006.01)

(52) U.S. Cl. ..... 399/159; 430/56

(58) Field of Classification Search ..... 399/159, 399/26, 162; 430/56, 902
See application file for complete search history.

(56) References Cited

U.S. PATENT DOCUMENTS 5,623,716 A * 4/1997 Masaki et al. ..... 399/159
6,773,857 B2 * 8/2004 Nakamura et al. ..... 399/159 X
2002/0031378 A1 * 3/2002 Arai et al. ..... 399/286

FOREIGN PATENT DOCUMENTS

JP 3-248646 A 9/1996
JP 8-248646 A 9/1996

(Continued)

OTHER PUBLICATIONS

International Search Report of PCT/JP2004/004681, mailed Jun. 1, 2004.

(Continued)

*Primary Examiner*—Sophia S. Chen
(74) *Attorney, Agent, or Firm*—Nixon & Vanderhye, P.C.

(57) ABSTRACT

An electrophotographic photoreceptor using a non-contact type charging process has a creep value $C_{\gamma\tau}$ of is 2.70% or more, preferably 3.00% or more, and a Vickers hardness (HV) at its surface of 20≦HV≦25 in a case where a maximum indenting load of 30 mN is loaded to the surface under a circumstance at a temperature of 25° C. and at a relative humidity of 50%. Since such an electrophotographic photoreceptor is excellent in flexibility and has plasticity not too soft nor exhibiting fragility, the amount of film reduction due to wear is decreased during long time use, excellent surface smoothness is ensured, and there is no occurrence of injury or unevenness in density to the formed images.

4 Claims, 6 Drawing Sheets

FOREIGN PATENT DOCUMENTS

| | | | |
|---|---|---|---|
| JP | 10-207086 | A | 8/1998 |
| JP | 2000-10320 | A | 1/2000 |
| JP | 2001-125298 | A | 5/2001 |
| JP | 2002-6526 | A | 1/2002 |
| JP | 2002-268243 | A | 9/2002 |
| JP | 2003-5410 | A | 1/2003 |
| JP | 2003-316037 | A | 11/2003 |
| JP | 2004-077591 | A * | 3/2004 |

OTHER PUBLICATIONS

International Preliminary Report on Patentability and English translation thereof mailed Oct. 27, 2005 and Mar. 9, 2006, respectively, in corresponding PCT application No. PCT/JP2004/004681.

* cited by examiner

ELECTROPHOTOGRAPHIC PHOTORECEPTOR AND IMAGE FORMING APPARATUS HAVING THE SAME

This application is the US national phase of international application PCT/JP2004/004681, filed 31 Mar. 2004, which designated the U.S. and claims priority of JP 2003-101694, filed 4 Apr. 2003, the entire contents of each of which are hereby incorporated by reference.

TECHNICAL FIELD

The present invention relates to an electrophotographic photoreceptor for use in electrophotographic image formation, and an image forming apparatus having the same.

BACKGROUND ART

Electrophotographic image forming apparatus have been utilized not only for copying machines but also generally for printers as output means of computers, etc. for which demand has been increased remarkably in recent years. In the electrophotographic image forming apparatus, toner images are formed by uniformly charging a photosensitive layer of an electrophotographic photoreceptor provided to the apparatus by a charger, exposing the same, for example, by a laser light corresponding to image information, and supplying a particulate developer referred to as a toner from a developing device to electrostatic latent images formed by exposure.

While toner images formed by deposition of the toner as an ingredient of a developer to the surface of the electrophotographic photoreceptor is transferred by transfer means to a transfer material such as recording paper. However, not all the toner on the surface of the electrophotographic photoreceptor is transferred to the recording paper but the toner partially remains on the surface of the electrophotographic photoreceptor. Further, paper dusts of recording paper in contact with the electrophotographic photoreceptor during development may sometimes remain being deposited to the electrophotographic photoreceptor as they are.

Since the residual toner and the deposited paper dusts on the surface of the electrophotographic photoreceptor give undesired effects on the quality of images to be formed, they are removed by a cleaning device. Further, a cleanerless technique has been developed in recent years and they are removed by a so-called development and cleaning system of recovering the residual toner by a cleaning function added to the developing means without providing independent cleaning means. For the electrophotographic photoreceptor, since operations of charging, exposure, development, transfer, cleaning and charge elimination are conducted repetitively, a durability to electrical and mechanical external forces has been demanded. Specifically, it has been required for durability against abrasion or injury occurred upon frictional rubbing to the surface of the electrophotographic photoreceptor or against degradation of the surface layer caused by deposition of active substances such as ozone or NOx generated upon charging by the charger.

For attaining the reduction of cost and free of maintenance in the electrophotographic image forming apparatus, it is important that the electrophotographic photoreceptor has sufficient durability and can operate stably for a long time. The physical property of the surface layer constituting the electrophotographic photoreceptor has a great concern with the durability and the long time stability of operation of the electrophotographic photoreceptor.

Hardness is one of indices for generally evaluating physical properties of the materials, particularly, mechanical properties, not being restricted only to the physical property on the surface of an electrophotographic photoreceptor. The hardness is defined as a stress from a material against intrusion of an indenter. An attempt of quantitizing the mechanical property of a film that constitutes the surface of the electrophotographic photoreceptor by using the hardness as a physical parameter for recognizing the physical property of materials has been conducted. For example, scratch resistant test, pencil hardness test and Vickers hardness test, etc. have been generally known as the test method for measuring the hardness.

However, each of the hardness tests described above involves a problem in measuring the mechanical properties of a material showing complicate behaviors of plasticity, elasticity (also including retarded component) and creeping property in combination such a film comprising or organic material. For example, while Vickers hardness is used for the evaluation of hardness of a film by measuring the length of an indentation, this reflects only the plasticity of the film and can not exactly evaluate the mechanical property such as of those comprising an organic material showing a deformation state also including elastic deformation at a large ratio. Accordingly, the mechanical property of a film constituted with an organic material has to be evaluated in view of various properties.

One of prior arts for evaluating the physical property of the surface layer of the electrophotographic photoreceptor having the organic photosensitive layer proposes the use of a universal hardness value (Hu) and plastic deformation ratio according to the universal hardness test as specified in DIN 50359-1 (for example, refer to the publication of Japanese Unexamined Patent Publication JP-A 2000-10320). This prior art discloses that mechanical degradation less occurs to the surface layer of the photoreceptor when defining Hu and plastic deformation ratio to a specified range. However, substantially all light sensitive bodies having charge transporting layers using polymeric binders generally used at present are included in the definition range for the elasticity disclosed in JP-A 2000-10320 and this results in a problem that a suitable range is not defined substantially.

Further, in another prior art for evaluating the physical property of the surface layer of the electrophotographic photoreceptor, it has been disclosed that the scratch resistance of the photoreceptor can be improved by defining the Young's modulus as the mechanical property other than the hardness to a specified range together with the universal hardness value (Hu) described above in the photoreceptor provided to electrophotographic image forming apparatus using a contact charging process (for example refer to the publication of Japanese Unexamined Patent Publication JP-A 2001-125298).

However, another prior art is restricted to the case of using the contact charging process. In the electrophotographic system using an electrophotographic photoreceptor for image formation, the process for charging the photoreceptor is generally classified into two types, i.e., contact charging as disclosed in another prior art and non-contact charging using, for example, a scorotron. Accordingly, a difference is naturally present between the contact charging and non-contact charging due to the difference of the charging mode, for the performance required for the photoreceptor used respectively in them. This results in a problem that a suitable range for defining the surface physical property value for the electrophotographic photoreceptor using the contact type charging process can not be applied as it is to the surface physical property of the electrophotographic photoreceptor using the non-contact type charging process.

BRIEF SUMMARY

An object of the technology is to provide an electrophotographic photoreceptor using a non-contact type charging process excellent in wear resistance life and not causing injury and unevenness in density to the images to be formed for a long time by defining physical properties of the surface.

The technology provides an electrophotographic photoreceptor in which electrostatic latent images are formed by exposure of a surface charged in a non-contact manner with a light in accordance with image information, toner images are formed by development of the electrostatic latent images, and obstacles including a toner are removed from the surface after the toner images are transferred onto a transfer material, wherein a creep value $C_{Jr}$ is 2.70% or more and the Vickers hardness (HV) at the surface is 20 or more and 25 or less in a case where a maximum indenting load of 30 mN is loaded to the surface under a circumstance at a temperature of 25° C. and at a relative humidity of 50%.

Further, the technology is characterized in that the creep value $C_{Jr}$ is 3.00% or more.

In accordance with the technology, surface physical properties of an electrophotographic photoreceptor used for electrophotographic image formation and charged by a non-contact type charging process are set such that the creep value $C_{Jr}$ is 2.70% or more, preferably, 3.00% or more in a case where a maximum indenting load of 30 mN is loaded on the surface under a circumstance at a temperature of 25° C. and at a relative humidity of 50% and a Vickers hardness (HV) at the surface is 20 or more and 25 or less. This can maintain the soft and flexibility of a film forming the surface layer of the electrophotographic photoreceptor and render the plasticity of the film into a suitable state which is neither excessively soft nor fragile. Accordingly, even during long time use where image formation of charging, exposure, development, transfer, cleaning and charge elimination is repeated, since the amount of film reduction is decreased and occurrence of injury to the film is decreased to keep the smoothness on the surface of the photoreceptor, occurrence of injury or unevenness in density to the formed images can be prevented.

Further, the technology provides an image forming apparatus comprising:

an electrophotographic photoreceptor in which the surface is charged in a non-contact manner and a creep value $C_{Jr}$ is 2.70% or more in a case where a maximum intending load of 30 mN is loaded to the surface under a circumstance at a temperature of 25° C. and at a relative humidity of 50% and the Vickers hardness (HV) at the surface is 20 or more and 25 or less, charging means for charging the surface of the electrophotographic photoreceptor in a non-contact manner, exposure means for forming electrostatic latent images by exposure of the charged surface of the electrophotographic photoreceptor by a light in accordance with image information, developing means for developing the electrostatic latent images to form toner images, transfer means for transferring the toner images from the surface of the electrophotographic photoreceptor to a transfer material, and cleaning means for cleaning the surface of the electrophotographic photoreceptor after transfer of the toner images.

Further, the technology is characterized in that the creep value $C_{Jr}$ in the electrophotographic photoreceptor is 3.00% or more.

In accordance with the technology, since the electrophotographic photoreceptor excellent in the wear resistance life and scratch resistance is provided, an image forming apparatus not causing injury or unevenness in the density to the formed images is obtained.

BRIEF DESCRIPTION OF THE DRAWINGS

Other and further objects, features, and advantages of the invention will be more explicit from the following detailed description taken with reference to the drawings wherein.

DETAILED DESCRITION

Figure 1:
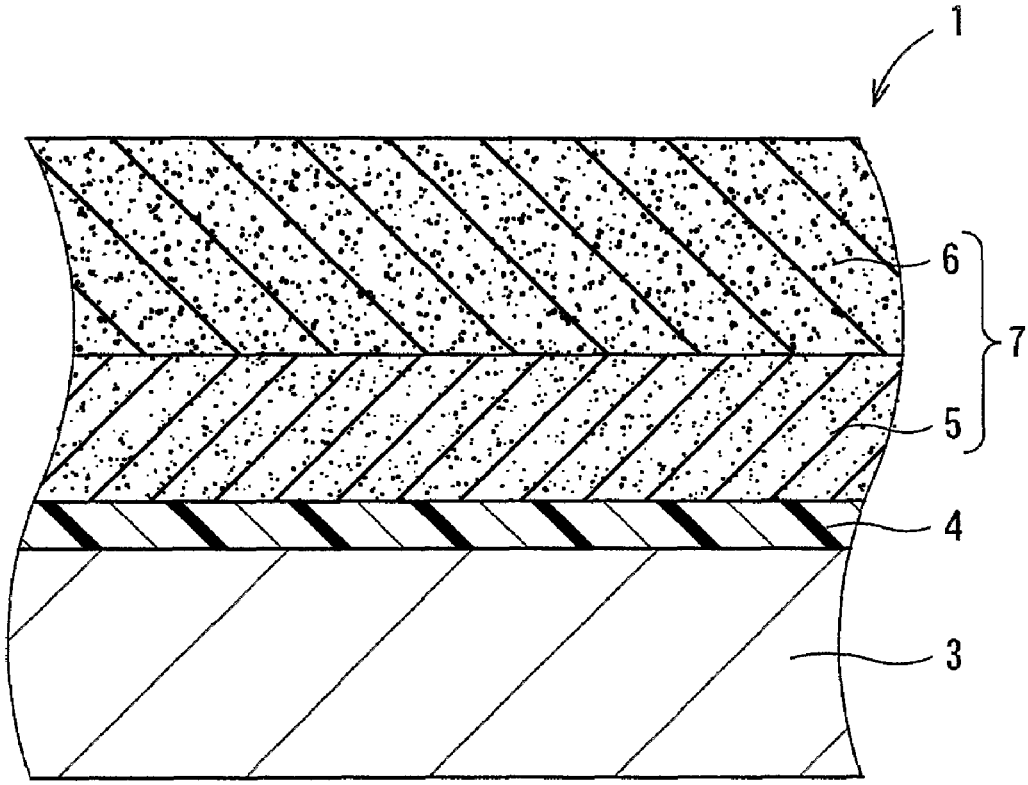
FIG. 1 is a fragmentary cross sectional view schematically showing the constitution of an electrophotographic photoreceptor according to an example embodiment.

Now referring to the drawings, preferred example embodiments are described below.

Figure 2:
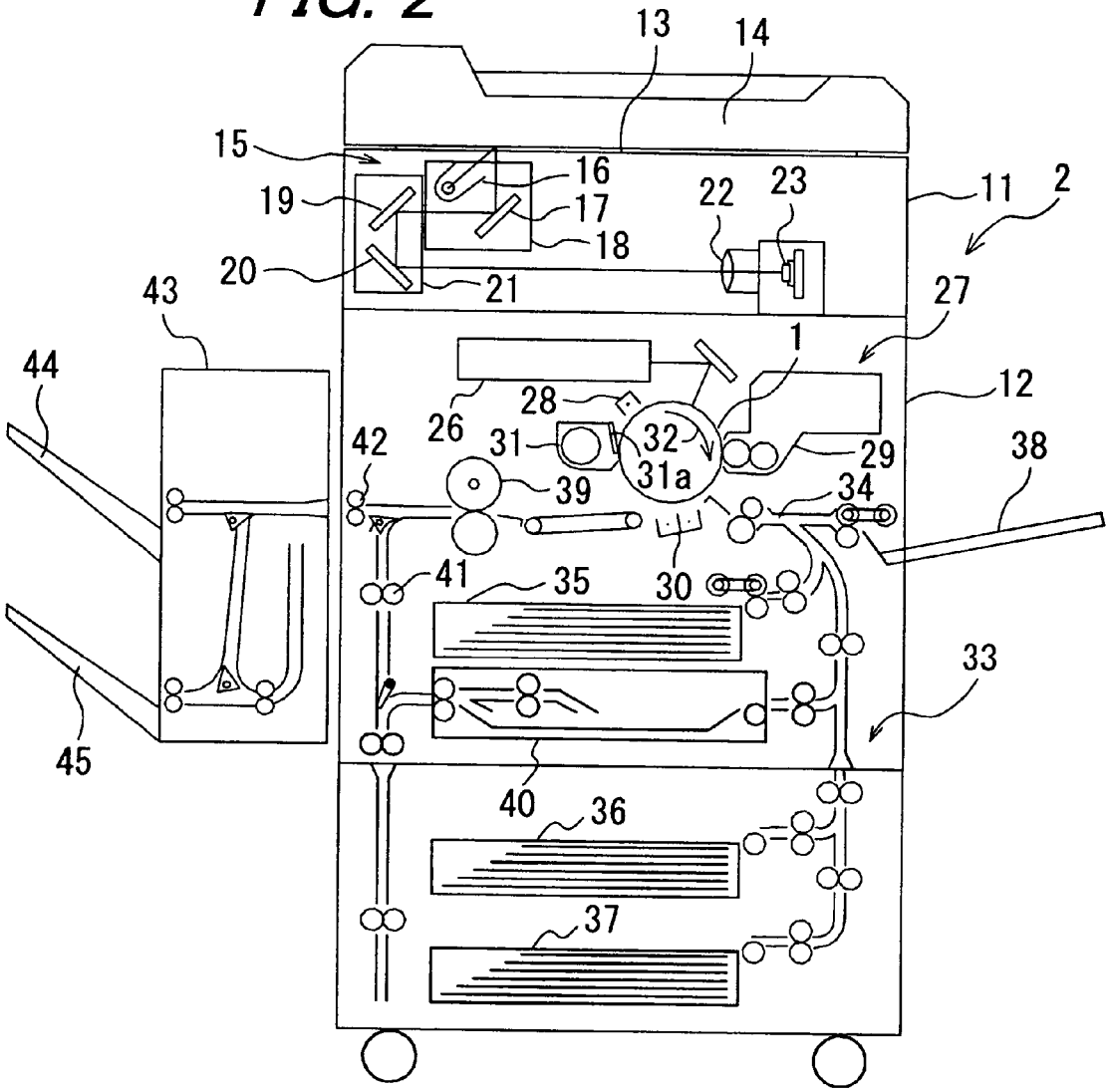
FIG. 2 is a side elevational view for the arrangement schematically showing the constitution of an image forming apparatus according to another example embodiment having the electrophotographic photoreceptor shown in FIG. 1.

FIG. 1 is a fragmentary cross sectional view schematically showing the constitution of an electrophotographic photoreceptor 1 according to an example embodiment, and FIG. 2 is a side elevational view for the arrangement schematically showing the constitution of an image forming apparatus 2 according to another example embodiment having the electrophotographic photoreceptor 1 shown in FIG. 1.

The electrophotographic photoreceptor 1 (hereinafter simply referred to as a photoreceptor) comprises a conductive substrate 3 made of a conductive material, an undercoat layer 4 stacked on the conductive substrate 3, a charge generating layer 5 which is a layer stacked on the undercoat layer 4 and containing a charge generating substance, and a charge transporting layer 6 which is a layer stacked further on the charge generating layer 5 and containing a charge transporting substance. The charge generating layer 5 and the charge transporting layer 6 constitute a photosensitive layer 7.

The conductive substrate 3 has a cylindrical shape and (a) a metal material such as aluminum, stainless steel, copper and nickel, or (b) an insulating material such as polyester film, phenol resin pipe, or paper pipe provided at the surface thereof with a conductive layer such as aluminum, copper, palladium, tin oxide, or indium oxide is preferably used. Those having electroconductivity at a volumic resistance of $10^{10}$ Ω·cm or less are preferred. The conductive substrate 3 may be applied with an oxidation treatment to the surface with an aim of controlling the volumic resistance. The conductive substrate 3 functions as the electrode for the photoreceptor 1, as well as also functions as a support member for each of other layers 4, 5, and 6. The shape of the conductive substrate 3 is not restricted only to the cylindrical shape but any of plate-like, film-like, or belt-like shape may also be used.

The undercoat layer 4 is formed, for example, of polyamide, polyurethane, cellulose, nitrocellulose, polyvinyl alcohol, polyvinyl pyrrolidone, plyacrylamide, anodized aluminum film, gelatin, starch, casein, or N-methoxymethylated nylon. Further, particles such as titanium oxide, tin oxide or aluminum oxide may be dispersed in the undercoat layer 4. The undercoat layer 4 is formed to a thickness of about 0.1 to 10 μm. The undercoat layer 4 serves as an adhesive layer between the conductive substrate 3 and the photosensitive layer 7, as well as functions also as a barrier layer that suppresses charges from flowing to the photosensitive layer 7 from the conductive substrate 3. As described above, since the undercoat layer 4 functions so as to maintain the charging characteristics of the photoreceptor 1, it can extend the life of the photoreceptor 1.

The charge generating layer 5 can be constituted by incorporation of a known charge generating substance. As the charge generating substance, any of inorganic pigments, organic pigments and organic dyes can be used so long as the material absorbs visible rays to generate free charges. The inorganic pigments include selenium and alloys thereof, arsenic-selenium, cadmium sulfide, zinc oxide, amorphous silicon, and other inorganic photoconductors. The organic pigments include phtalocyanine compounds, azo compounds, quinacridone compounds, polycyclic quinone compounds, and perylene compounds. The organic dyes include thiapyrylium salts and squarylium salts. Among the charge generating substances described above, organic photoconductive compounds such as organic pigments and organic dyes are preferably used and, among the organic photoconductive compounds, phthalocyanine compounds are preferably used. Particularly, use of titanylphthalocyanine compounds is most preferred and satisfactory sensitivity, chargeability and reproducibility can be obtained.

In addition to the pigments and dyes described above, the charge generating layer 5 may be incorporated with chemical sensitizers or photosensitizers. The chemical sensitizer includes electron accepting materials, for example, cyano compounds such as tetracyanoethylene, 7,7,8,8-tetracyanoquinodimethane, quinones such as anthraquinone and p-benzoquinone, and nitro compounds such as 2,4,7-trinitrofluolenone and 2,4,5,7-tetranitrofluolenone. The photosensitizers include dyes such as xanthene dyes, thiadine dyes, and triphenylmethane dyes.

The charge generating layer 5 is prepared by dispersing the charge generating substance described above together with a binder resin in an appropriate solvent, and stacking the same on an undercoat layer 4, followed by drying or curing to form a film. Specifically, the binder resin includes, for example, polyarylate, polyvinyl butyral, polycarbonate, polyester, polystyrene, polyvinyl chloride, phenoxy resin, epoxy resin, silicone, and polyacrylate. The solvent includes, for example, isopropyl alcohol, cyclohexanone, cyclohexane, toluene, xylene, acetone, methyl ethyl ketone, tetrahydrofuran, dioxane, dioxolane, ethylcellosolve, ethyl acetate, methyl acetate, dichloromethane, dichloroethane, monochlorbenzene, and ethylene glycol dimethyl ether.

The solvent is not limited to those described above, but any solvent selected from alcohols, ketones, amides, esters, ethers, hydrocarbons, chlorinated hydrocarbons, and aromatics may be used each alone or in admixture. However, considering the degradation of the sensitivity resulted from crystal relocation upon pulverization and milling of the charge generating substance and deterioration of characteristics due to the pot life, use of any one of cyclohexanone, 1,2-dimethoxyethane, methyl ethyl ketone and tetrahydroquione, in organic or inorganic pigments, which cause less crystal relocation are preferred.

For the formation of the charge generating layer 5, a vapor phase deposition method such as a vacuum vapor deposition method, sputtering method or CVD method, coating method, etc. can be used. In a case of using the coating method, a coating solution prepared by pulverizing the charge generating substance by a ball mill, sand grinder, paint shaker, or ultrasonic disperser and dispersing the same in a solvent, and optionally adding a binder resin is applied on an undercoat layer 4 by a known coating method. In a case where the conductive substrate 3 formed with the undercoat layer 4 has a cylindrical shape, a spray method, vertical ring method, or dip coating method can be used as the coating method. The film thickness of the charge generating layer 5 is, preferably, about from 0.05 to 5 μm and, more preferably, about from 0.1 to 1 μm.

In a case where the conductive substrate 3 formed with the undercoat layer 4 is in a sheet-like shape, an applicator, bar coater, casting, or spin coating can be used for the coating method.

The charge transporting layer 6 can be constituted with incorporation of a known charge transporting substance and a binder resin. It may suffice that the charge generating layer 6 has an ability of accepting charges generated from the charge generating substance contained in the charge generating layer 5 and transferring them. The charge transporting substance includes electron donating materials, for example a poly-N-vinylcarbazole and derivative thereof, poly-g-carbazolylethylglutamate and derivative thereof, polyvinyl pyrene, polyvinyl phenanthrene, oxazole derivative, an oxadiazole derivative, an imidazole derivative, 9-(p-diethyl aminostyryl)anthracene, 1,1-bis(4-dibenzylaminophenyl) propane, styrylanthracene, styrylpyrazoline, pyrazoline derivative, phenylhydrazones hydrazone derivatives, triphenylamino compounds, tetraphenyldiamine compounds, stylbene compounds, or azine compounds such as 3-methyl-2-benzothiazoline ring.

The binder resin which constitutes the charge transporting layer 6 may be those compatible with the charge transporting substance and includes, for example, polycarbonate and copolymerized polycarbonate, polyallylate, polyvinyl butyral, polyamide, polyester, epoxy resin, polyurethane, polyketone, polyvinyl ketone, polystyrene, polyacrylamide, phenol resin, phenoxy resin and polysulfone resin, and copolymer resins thereof. Those resins can be used each alone or two or more of them may be used in admixture. Among the binder resins described above, resins such as polystyrene, polycarbonate and copolymerized polycarbonate, polyallylate and polyester have a volumic resistivity of $10^{13}$ Ω or more and have excellent film-forming property, potential characteristics, etc.

As the solvent for dissolving the materials described above, alcohols such as methanol and ethanol, ketones such as acetone, methyl ethyl ketone and cyclohexanone, ethers such as ethyl ether, tetrahydrofuran, dioxane and dioxolane, halogenated aliphatic hydrocarbons such as chloroform, dichloromethane and dichloroethanes and aromatics such as benzene, chlorobenzene and toluene can be used.

The coating solution for charge transporting layer for forming the charge transporting layer 6 is prepared by dissolving the charge transporting substance in a binder resin solution. The ratio of the charge transporting substance based on the charge transporting layer 6 is preferably within a range from 30 to 80% by weight. The formation of the charge transporting layer 6 on the charge generating layer 5 is conducted in the same manner as the formation of the charge generating layer 5 on the undercoat layer 4. The thickness of the charge transporting layer 6 is preferably from 10 to 50 μm and, more preferably, from 15 to 40 μm.

The charge transporting layer 6 may be incorporated with one or more electron accepting materials or dyes, for improving the sensitivity and suppressing the increase of residual potential and fatigue during repetitive use. The electron accepting materials include acid anhydrides such as succinic acid anhydride, maleic acid anhydride, phthalic acid anhydride, 4-chlornaphthalic acid anhydride, cyano compounds such as tetracyanoethylene, terephthal malonedinitrile, aldehydes such as 4-nitrobenzaldehyde, anthraquinones such as anthraquinone and 1-nitroanthraquinone, polycyclic or heterocyclic nitro compounds such as 2,4,7-trinitrofluolenone, and 2,4,5,7-tetranitrofluolenone, and they can be used as a chemical sensitizer.

The dye includes, for example, organic photoconductive compounds such as xanthene dyes, thiadine dyes, triphenylmethane dyes, quinoline pigments and copper phthalocyanine. They can be used as the photosensitizer.

Further, the charge transporting layer 6 may be incorporated with a known plasticizer to improve the moldability, flexibility and mechanical strength. The plasticizer includes, for example, dibasic acid ester, fatty acid ester, phosphate ester, phthalate ester, chlorinated paraffin and epoxy type plasticizer. In addition, the photosensitive layer 7 may be incorporated, for example, with a leveling agent for preventing orange-peel appearance such as polysiloxane, phenolic compounds for improving durability, an anti-oxidant such as hydroquinone compounds, tocopherol compounds and amine compounds, and UV ray absorbers.

The physical property of the surface film of the photoreceptor 1 constituted as described above, that is, the physical property of the surface film of the photosensitive layer 7 formed into a film shape is set such that a creep value $C_{Jr}$ is 2.70% or more and, preferably, 3.00% or more and a Vickers hardness (HV) at the surface is 20 or more and 25 or less in a case where a maximum indenting load of 30 mN is loaded on the surface under a circumstance at a temperature of 25° C. and at a relative humidity of 50%.

Figure 3A:
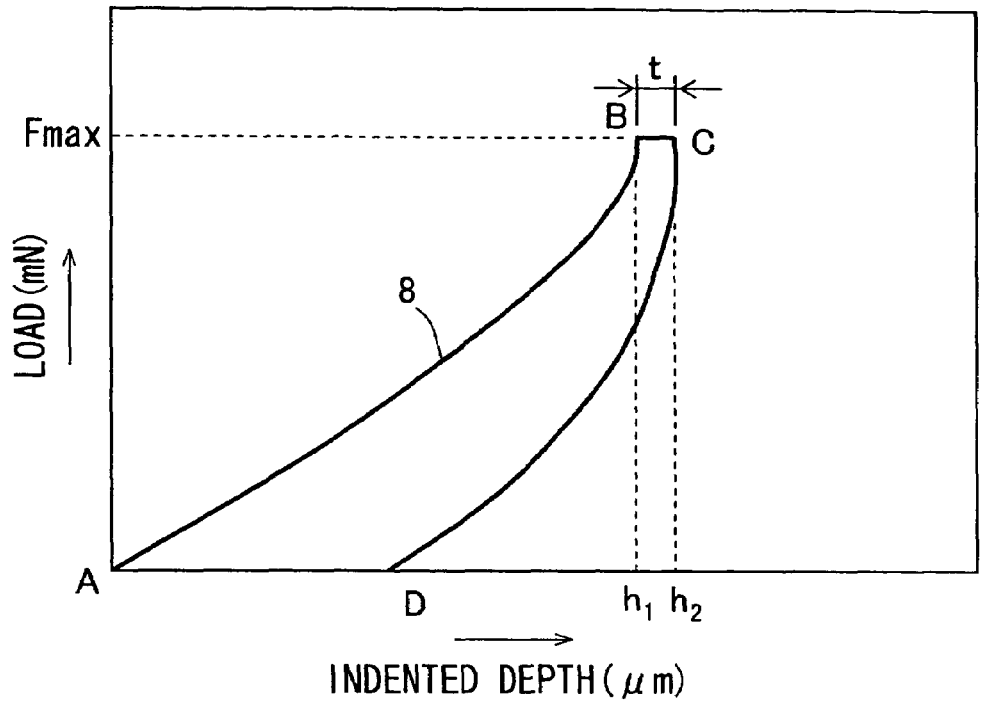
FIG. 3A and FIG. 3B are charts explaining a method of determining a creep value $C_{Jr}$.
Figure 3B:
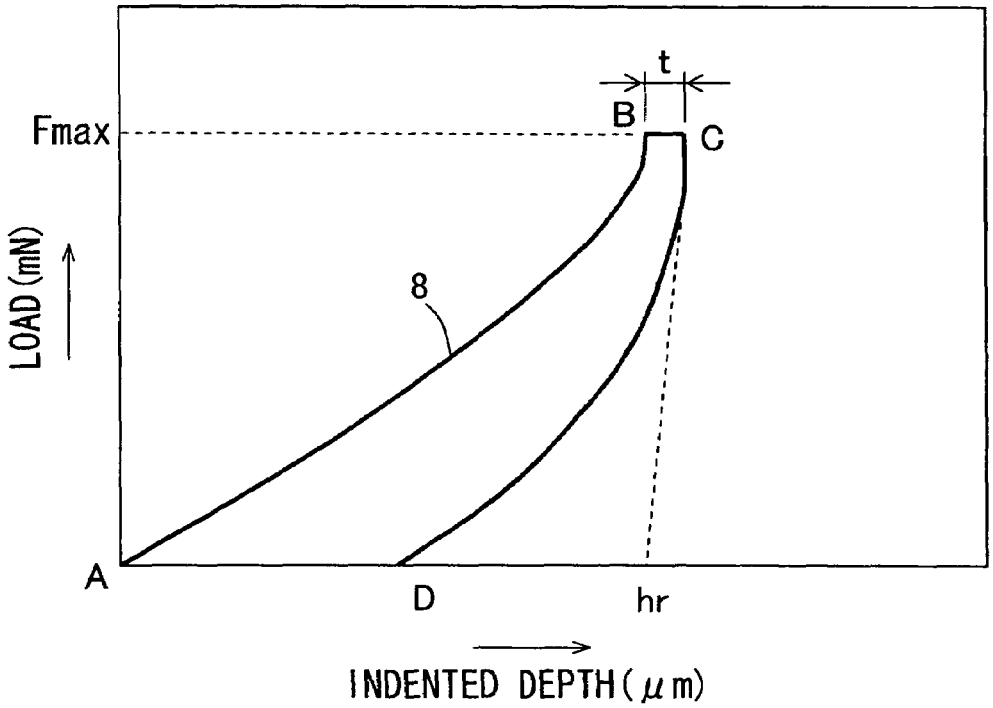

Now the creep value $C_{Jr}$ is to be described. Generally, a solid material, even under a relatively low load, gradually develops a continuous deformation phenomenon, so-called creep, along with lapse of time retaining applied load. The creep develops remarkably, particularly, in organic polymeric materials. The creep generally includes retarded elastic deformation component and plastic deformation component which is used as an index representing the soft and flexibility of the material. FIG. 3A and FIG. 3B are charts for explaining a method of determining the creep value $C_{Jr}$ and the Vickers hardness HV of a photoreceptor. The creep value $C_{Jr}$ is a parameter for evaluating the amount of change of the indenting amount of an indenter under a state of applying a predetermined load for a predetermined time on the surface of a photoreceptor by way of the indenter, that is, the degree of relaxation of the surface film of the photoreceptor relative to the indentation load.

Hysteresis profiles 8 shown in FIG. 3A and FIG. 3B show the deformation (change of indented depth) hysteresis of an indenting process from starting the application of indenting load to the surface of the photoreceptor 1 till reaching a predetermined maximum indentation load Fmax (A→B), a load retaining process for retaining the maximum indentation load Fmax for a predetermined time t (B→C), and a load removing process from starting the load removal till reaching a zero load (0) to complete load removal (C→D). The creep value $C_{Jr}$ is given as the amount of change of the indenting amount in the load retaining process (B→C).

In this embodiment, the creep value $C_{Jr}$ was measured by using a diamond indenter (Vickers indenter) of a square pyramidal shape as an indenter under a circumstance at a temperature of 25° C. at a relative humidity of 50% and under the condition of retaining the load for a predetermined period: t=5 sec at the maximum indentation load: Fmax=30 mN. The creep value CIT is specifically given by the following equation (1):

$$C_{Jr}=100\times(h_2-h_1)/h_1 \quad (1)$$

in which $h_1$: indented depth at the instance (B) reaching the maximum load 30 mN $h_2$: indented depth at the instance (C) after retained for a time t under the maximum load of 30 mN.

Such creep value $C_{Jr}$ is determined, for example, by a Fisher Scope H100V (manufactured by Fisher Instrument Co.)

The reason for defining the creep value $C_{Jr}$ for the surface of the photoreceptor 1 is to be described. While the surface of the photoreceptor 1 is deformed by an energy given when a cleaning member or the like is indented, the internal energy caused by deformation is relaxed (dispersed) to suppress proceeding of wear by defining the creep value $C_{Jr}$ to 2.70% or more thereby providing soft and flexibility. That is, the wear resistance life of the photoreceptor is improved. In a case where the creep value $C_{Jr}$ is less than 2.70%, the soft and flexibility on the surface of the photoreceptor is poor and the wear resistance due to the frictional rubbing with the cleaning member or the like is lowered to shorten the life.

While the upper limit for the creep value $C_{Jr}$ is not particularly limited, it is preferably set to 5.0% or less. In a case where the creep value $C_{Jr}$ exceeds 5.0%, the surface of the photoreceptor becomes excessively soft and flexible and, the deformation amount by indentation upon frictional rubbing, for example, with a cleaning member is large sometimes failing to obtain a sufficient cleaning effect.

Then, the Vickers hardness HV is to be described. The Vickers hardness (HV) is an index of the plasticity of a material, which is determined according to Japanese Industrial Standard (JIS) Z2244. The Vickers hardness (HV) in this embodiment is obtained by determining a plastic deformation hardness Huplast at first based on an intercept hr where a tangential line, relative to a point C of a load elimination curve obtained in the load elimination process (C→D) in the hysteresis profile 8 upon determining the creep value $C_{Jr}$ described above, intersects the axis for the indentation depth and a maximum intending load Fmax, and as a value corresponding to the plastic deformation hardness Huplast. Specifically, the plastic deformation hardness Huplast is obtained by the equation (2).

$$\text{Huplast}=F\text{max}/A(\text{hr}) \quad (2)$$

in which A(hr) is an indentation surface area at the intercept hr described above referred to as a repulsion indented depth and is given as: $A(\text{hr})=26.43\cdot\text{hr}^2$.

Figure 4:
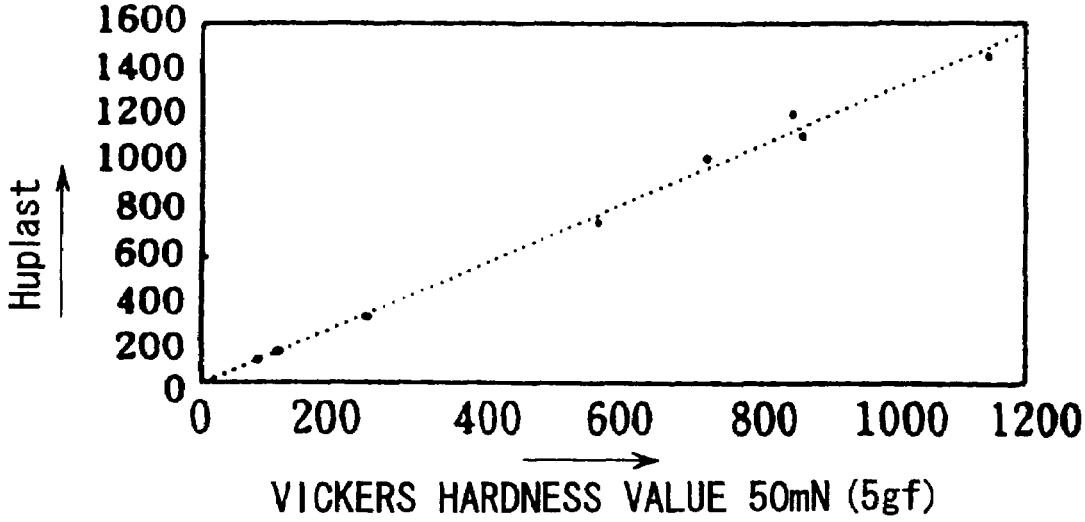
FIG. 4 is a view showing a relation between Vickers hardness HV and plastic deformation hardness Huplast.

FIG. 4 is a graph showing a relation between the Vickers hardness HV and the plastic deformation hardness Huplast. As shown in FIG. 4, since there is an extremely high correlation between the Vickers hardness HV and the plastic deformation hardness Huplast, the Vickers hardness HV corresponding to the plastic deformation hardness Huplast can be determined, in other words can be converted. Such Vickers hardness HV can be determined, for example, by a Fisher Scope H100V in the same manner as the creep value described above also including the conversion from the plastic deformation hardness Huplast to the Vickers hardness HV.

The reason for defining the Vickers hardness HV of the surface of the photoreceptor 1 is to be described. In a case where HV is less than 20, the mechanical strength at the surface is insufficient as the photoreceptor used for the electrophotographic system. On the other hand, in a case where HV exceeds 25, fragility on the surface of the photoreceptor develops in which occurrence of injury at the surface of the photoreceptor increases and the durability is worsened. Accordingly, the Vickers hardness HV was set to 20 or more and 25 or less.

The photoreceptor 1 in which the creep value $C_{I\tau}$ and the Vickers hardness HV are set to a predetermined range, soft and flexibility of the film upon forming the surface layer, that is, the photosensitive layer 7 is maintained and the plasticity of the film is neither excessively soft nor fragile. Accordingly, since the amount of film reduction is decreased and occurrence of injury to the film is also mitigated to keep the smoothness on the surface of the photoreceptor even during long time use where image formation of charging, exposure, development, transfer, cleaning, and charge elimination is conducted repetitively, this can prevent occurrence of injury or unevenness in the density in the formed images. The control for the creep value $C_{I\tau}$ and the Vickers hardness HV on the surface of the photoreceptor 1 is attained by controlling, for example, the kind and the blending ratio of the charge transporting substance and the binder resin constituting the photosensitive layer 7, stacked structure of the photosensitive layer 7, for example, combination of the thickness of the charge generating layer 5 and the thickness of the charge transporting layer 6, and the heat treatment condition after forming the charge generating layer 5 and the charge transporting layer 6.

Then, the operation of forming electrostatic latent images in the photoreceptor 1 is to be described briefly. The photosensitive layer 7 formed to the photoreceptor 1 is uniformly charged, for example, negatively by a charger or the like. When a light having an absorption wavelength is irradiated to the charge generating layer 5 in the charged state, charges of electrons and holes are generated in the charge generating layer 5. The holes are transferred by the charge transporting substance contained in the charge transporting layer 6 to the surface of the photoreceptor 1 to neutralize negative charges on the surface. Electrons in the charge generating layer 5 transfers on the side of the conductive substrate 3 where positive charges are induced to neutralize the positive charges. As described above, difference is caused between the charged amount in the exposed portion and the charged amount in the non-exposed portion to form electrostatic latent images to the photosensitive layer 7.

Then, with reference to FIG. 2, the constitution and the image forming operation of the image forming apparatus 2 having the photoreceptor 1 described above are to be explained. An image forming apparatus 2 exemplified in this embodiment is a digital copying machine 2.

The digital copying machine 2 has a constitution generally comprising a scanner station 11 and a laser recording section 12. The scanner station 11 includes a document platen 13 comprising transparent glass, a reversible automatic document feeder for both surfaces (RADF) 14 for supplying and feeding documents automatically onto the document platen 13 and a scanner unit 15 which is a document image reading unit for scanning images of an original document placed on the document platen 13 and reading them. Document images read by the scanner station 11 are sent as image data to an image data input station to be described later, and predetermined image processing is applied to the image data. In the RADF 14, A plurality of documents are set at the same time on a document tray not illustrated provided to RADF 14. RADF 14 is a device for feeding the set documents one by one automatically onto the document platen 13. Further, RADF 14 comprises a conveying path for documents of a single surface, a conveying path for documents of both surfaces, means for switching the conveying paths, a group of sensors for recognizing and controlling the state of documents passing through each of the stations, a control station, etc so as to cause the scanner unit 15 to read one surface or both surfaces of the document in accordance with the operator's selection.

The scanner unit 15 comprises a lamp reflector assembly 16 for exposing the surface of a document, a first scanning unit 18 mounting a first reflection mirror 17 for reflecting the reflection light from the document for introducing the reflection light images from the document to a photoelectronic conversion device (simply referred to as CCD) 23, a second scanning unit 21 for mounting second and third reflection mirrors 19 and 20 for introducing the reflection light images from the first reflection mirror 17 to the CCD 23, an optical lens 22 for focusing reflection optical images from the document by way of each of the reflection mirrors 17, 19, and 20 to the CCD 23 that converse them into electrical image signals, and the CCD 23.

The scanner station 11 is constituted so as to successively feed and place the documents to be read on the document platen 13 by the interlocking operation of the RADF 14 and the scanner unit 15 and read the document images by moving the scanner unit 15 along the lower surface of the document platen 13. The first scanning unit 18 scans at a constant velocity V in the direction of reading the document images along the document platen 13 (from left to right relative to the drawing sheet in FIG. 2). The second scanning unit 21 scans in parallel in the identical direction at a ½ speed (V/2) relative to the speed V. By the operation of the first and the second scanning units 18 and 21, images of documents placed on the document platen 13 are focused on every line successively to the CCD 23 and images can be read.

The image data obtained by reading the document images in the scanner unit 15 are sent to an image processing station to be described later and, after being applied with various kinds of image processing, are once stored in a memory of the image processing station. The image data in the memory are read out in accordance with the output instruction, and the read out image data are transferred to the laser recording section 12 to form images on the recording paper as the recording medium.

The laser recording section 12 comprises a recording paper conveying system 33, a laser writing unit 26, and an electrophotographic processing station 27 for forming images. The laser writing unit 26 comprises a semiconductor laser light source for emitting a laser light in accordance with image data read out from the memory after being read by the scanner unit 15 and stored in the memory, or image data transferred from an external device, a polygonal mirror for deflecting the laser light at an equi-angular speed, and an f-θ lens for compensating the laser light deflected at an equi-angular speed so as to be deflected at the equi-angular speed on the photoreceptor 1 provided to the electrophotographic processing station 27.

In the electrophotographic processing station 27, a charger 28, a developing device 29, a transfer device 30, and a cleaning device 31 are arranged at the periphery of a photoreceptor 1 in this order from the upstream to the down stream in the rotational direction of the photoreceptor 1 shown by an arrow 32. As described above, the photoreceptor 1 is uniformly charged by the charger 28 and exposed in the charged state by the laser light corresponding to the document image data emitted from the laser writing unit 26. Electrostatic latent images formed by exposure to the surface of the photoreceptor 1 are developed by the toner supplied from the developing device 29 into toner images as visible images. The toner images formed on the surface of the photoreceptor 1 are transferred by the transfer device 30 onto recording paper as a transfer material fed from a conveying system 33 to be described later.

The photoreceptor 1 rotating further in the direction of the arrow 32 after transfer of toner images to the recording paper is frictionally rubbed at the surface thereof with a cleaning blade 31*a* provided to the cleaning device 31. Toner forming the toner images on the surface of the photoreceptor 1 is not entirely transferred onto the recording paper but sometimes remains slightly on the surface of the photoreceptor 1. The toner remaining on the surface of the photoreceptor is referred to as the residual toner and, since the presence of the residual toner causes degradation of the quality of the formed images, it is removed and cleaned from the surface of the photoreceptor together with other obstacles such as paper dusts by the cleaning blade 31*a* pressed to the surface of the photoreceptor.

The conveying system 33 for the recording paper comprises a conveying section 34 for conveying recording paper to the electrophotographic processing station 27, for conducting image formation, particularly, to a transfer position where the transfer device 30 is located, first to third cassette feeders 35, 36, and 37 for sending the recording paper into the conveying section 34, a manual feeder 38 for properly feeding recording paper of a desired size, a fixing device 39 for fixing images, particularly, toner images transferred from the photoreceptor 1 to the recording paper, and a re-feeding path 40 for re-feeding the recording paper for forming images further to the rear face of the recording paper after fixing of toner images (surface on the side opposite to the surface formed with the toner images). A plurality of conveying rollers 41 are arranged along the conveying paths of the conveying system 33 and the recording paper is conveyed by the conveying rollers 41 to a predetermined position in the conveying system 33.

The recording paper applied with a fixing treatment for the toner images by the fixing device 39 is fed to the re-feeding path 40 for forming images on the rear face, or fed to a post-processing device 43 by a discharge roller 42. The recording paper fed to the re-feeding path 40 is applied with the foregoing operation repetitively and images are formed at the rear face thereof. The recording paper fed to the post-processing device 43 is applied with post-processing and then discharged to either first or second discharge cassette 44 or 45 as a designation of discharge determined depending on the post-processing step. Thus, a series of image forming operations in the digital copying machine 2 is completed.

The photoreceptor 1 provided to the digital copying machine 2 is excellent in the soft and flexibility of the film that forms the photosensitive layer 7, and the plasticity of the film is not excessively soft or it is not fragile. Accordingly, since the amount of film reduction in the photoreceptor 1 is decreased, and occurrence of injury to the film is also decreased to keep the smoothness on the surface of the photoreceptor 1, an image forming apparatus not suffering from injury or unevenness in the density for images to be formed can be attained.

Figure 5:
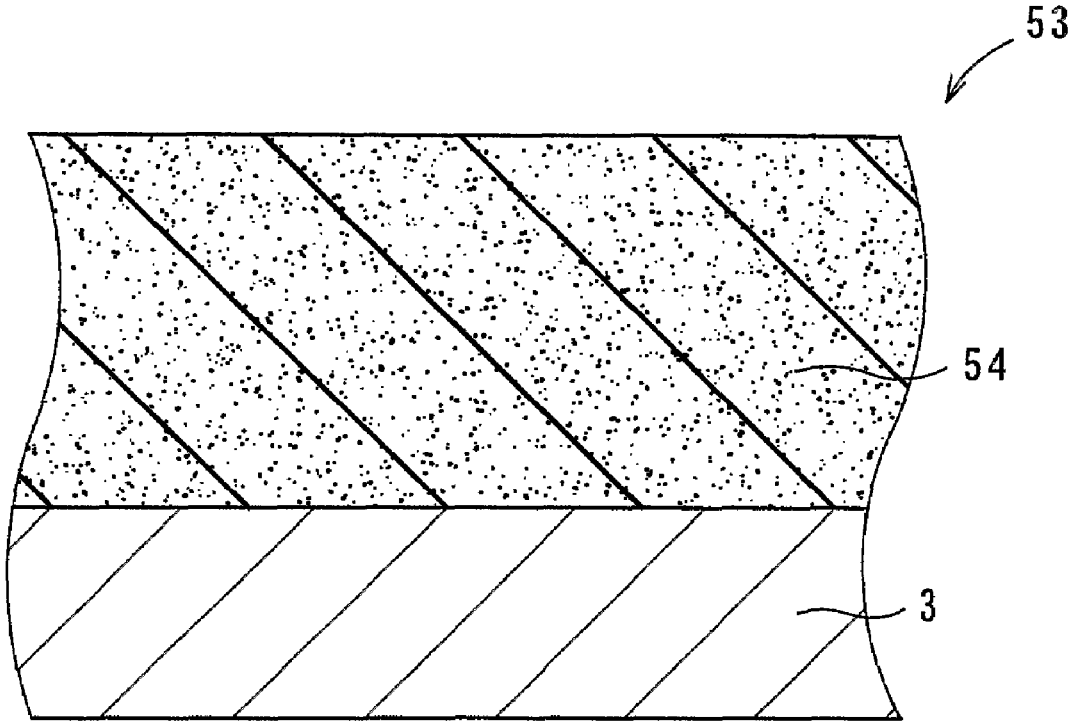
FIG. 5 is a fragmentary cross sectional view schematically showing the constitution of a photoreceptor 53 as a second example embodiment.

FIG. 5 is a fragmentary cross sectional view schematically showing the constitution of a photoreceptor 53 as a second embodiment of the invention. The photoreceptor 53 in this embodiment is similar with the photoreceptor 1 of the first embodiment, with corresponding portions carrying same reference numerals, for which descriptions are to be omitted. What is to be noted in the photoreceptor 53 is that a photosensitive layer 54 comprising a single layer is formed on a conductive substrate 3.

The photosensitive layer 54 is formed by using the same charge generating substance, charge transporting substance, binder resin, etc. as those used for the photoreceptor 1 of the first embodiment. A single photosensitive layer is formed on a conductive substrate 3 by the same method as that for forming the charge generating layer 5 in the photoreceptor 1 of the first embodiment, by using a coating solution for photosensitive layer prepared by dispersing the charge generating substance and the charge transporting substance in the binder resin or dispersing the charge generating substance in the form of pigment particles in the photosensitive layer containing the charge transporting substance. Since the single layered type photoreceptor 53 of this embodiment has the photosensitive layer 54 to be coated consisting of one layer, it is excellent compared with the stacked type constituted by stacking the charge generating layer and the charge transporting layer in view of the production cost and the yield.

EXAMPLE

The invention will be explained with reference to examples.

At first, description is to be made for light sensitive bodies provided as examples and comparative examples by forming photosensitive layers under various conditions on cylindrical conductive substrates made of aluminum 30 mm in diameter and 346 mm in length.

Examples 1 to 3

3 parts by weight of titanium oxide TTO-MI-1 (dendritic rutile type titanium oxide treated at the surface with $Al_2O_3$ and $ZrO_2$, titanium ingredient 85%, manufactured by Ishihara Sangyo Co. Ltd.) and 3 parts by weight of an alcohol soluble nylon resin CM 8000 (manufactured by Toray Industries Inc.) were added to a mixed solvent of 60 parts by weight of methyl alcohol and 40 parts by weight of 1,3-dioxolane, which was dispersed by a paint shaker for 10 hours to prepare a coating solution for undercoat layer. The coating solution was filled in a coating vessel, a conducive substrate was dipped therein and then pulled up, and spontaneously dried to form an undercoat layer having a layer thickness of 0.9 μm.

10 parts of a butyral resin S-LEC BL-2 (manufactured by Sekisui Chemical Co. Ltd.), 1400 parts by weight of 1,3-dioxolane, and 15 parts by weight of titanyl phthalocyanine represented by the following structural formula (1) were put to dispersion treatment by a ball mill for 72 hours, to prepare a coating solution for charge generating layer. The coating solution was applied on the undercoat layer by the dip coating method in the same manner as in the case of the undercoat layer and spontaneously dried to form a charge generating layer having a layer thickness of 0.4 μm.

Then, as the charge transporting substance, 100 parts by weight of the butadiene series compound represented by the structural formula (2), 48 parts by weight, 32 parts by weight and 32 parts by weight three types of a polycarbonate resins J-500, G-400, and GH503 (manufactured by Idemitsu Kosan Co., Ltd.), 48 parts by weight of a polycarbonate resin TS2020 (manufactured by Teijin Chemicals Ltd.) and, further, 5 parts by weight of Sumilizer BHT (manufactured by Sumitomo chemical Co., Ltd.) were mixed and dissolved in 980 parts by weight of tetrahydrofuran to prepare a coating solution for charge transporting layer. The coating solution was applied on the charge generating layer by a dip coating method, and dried at 130° C. for 1 hour to form a charge transporting layer having a layer thickness of 28 μm. Thus, a photoreceptor of Example 1 was prepared.

(1)

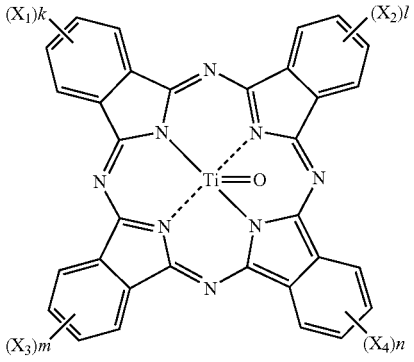

(2)

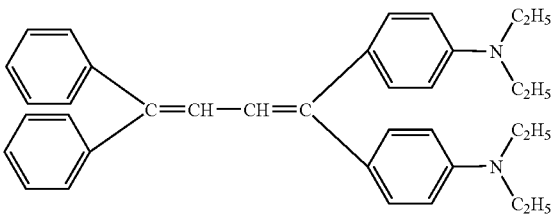

Example 2

An undercoat layer and a charge generating layer were formed in the same manner as in Example 1. Then, 100 parts by weight of an enamine series compound shown by the following structural formula (3) as the charge transporting substance, and 99 parts by weight and 81 parts by weight of two types of polycarbonate resins GK-700 and GH503 (manufactured by Idemitsu Kosan Co., Ltd.) were dissolved in 1050 parts by weight of tetrahydrofuran to prepare a coating solution for charge transporting layer. Using the coating solution, a photoreceptor of Example 2 was prepared in the same manner as in Example 1.

(3)

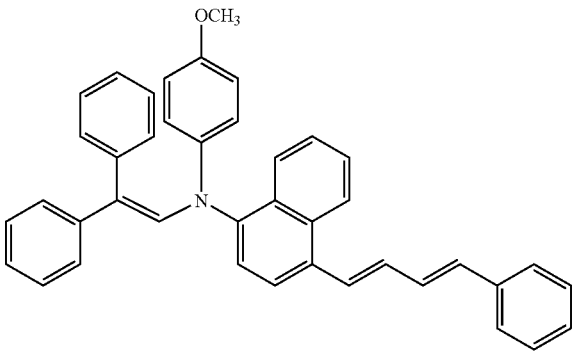

Example 3

A photoreceptor of Example 3 was prepared in the same manner as in Example 2 except for using 99 parts by weight of G-400 (manufactured by Idemitsu Kosan Co., Ltd.) and 81 parts by weight of GH503 (manufactured by Idemitsu Kosan Co., Ltd.) as the polycarbonate resin upon forming the charge transporting layer.

Comparative Examples 1 to 5

Comparative Example 1

An undercoat layer and a charge generating layer were formed in the same manner as in Example 1. Then, 100 parts by weight of a butadiene series compound represented by the structural formula (2), 88 parts by weight of a polycarbonate resin G-400 (manufactured by Idemitsu Kosan Co., Ltd.) and 72 parts by weight of a polycarbonate resin TS2020 (manufactured by Teijin Chemicals Ltd.) and, further, 5 parts by weight of Sumilizer-BHT (manufactured by Sumitomo Chemical Co. Ltd.) were mixed as the charge transporting substance and dissolved in 980 parts by weight of tetrahydrofuran to prepare a coating solution for charge transporting layer. Using the coating solution, a photoreceptor of Comparative Example 1 was prepared in the same manner as in Example 1.

Comparative Example 2

An undercoat layer and a charge generating layer were formed in the same manner as in Example 1. Then, 100 parts by weight of a enamine compound represented by the structural formula (3), 99 parts by weight of a polycarbonate resin GH-503 (manufactured by Idemitsu Kosan Co., Ltd.), and 81 parts by weight of a polycarbonate resin M-300 (manufactured by Idemitsu Kosan Co., Ltd.) were dissolved as the charge transporting substance in 1050 parts by weight of tetrahydrofuran to prepare a coating solution for charge transporting layer. Using the coating solution, a photoreceptor of Comparative Example 1 was prepared in the same manner as in Example 1.

Comparative Example 3

A photoreceptor of Comparative Example 3 was prepared in the same manner as in Comparative Example 2 except for using 180 parts by weight of M-300 (manufactured by Idemitsu Kosan Co., Ltd.) as the polycarbonate resin upon forming the charge transporting layer.

Comparative Example 4

An undercoat layer and a charge generating layer were formed in the same manner as in Example 1. Then, 100 parts by weight of a styryl series compound represented by the structural formula (4), 105 parts by weight of a polycarbonate resin G-400 (manufactured by Idemitsu Kosan Co., Ltd.), 45 parts by weight of a polycarbonate resin V290 (manufactured by Toyobo Co.) and, further, one part by weight of Sumilizer BHT (manufactured by Sumitomo Chemical Co., Ltd.) were mixed as the charge transporting substance and dissolved in 980 parts by weight of tetrahydrofuran to prepare a coating solution for charge transporting layer. Using the coating solution, a photoreceptor of Comparative Example 4 was prepared in the same manner as in Example 1.

(4)

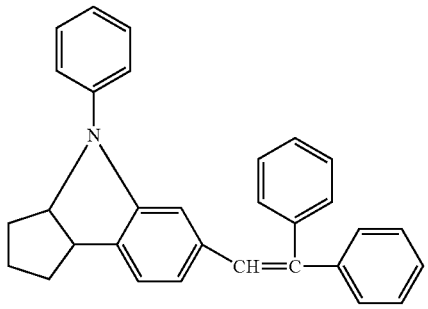

Comparative Example 5

An undercoat layer and a charge generating layer were formed in the same manner as in Example 1. Then, 100 parts by weight of a butadiene series compound represented by the structural formula (2) and 160 parts by weight of a polycarbonate resin G-400 (manufactured by Idemitsu Kosan Co., Ltd.) were dissolved as the charge transporting substance in 980 parts by weight of tetrahydrofuran to prepare a coating solution for charge transporting layer. Using the coating solution, a photoreceptor of Comparative Example 5 was prepared in the same manner as in Example 1.

As described above, in the preparation for each of the light sensitive bodies of Examples 1 to 3 and Comparative 1 to 5, the creep value $C_{\mu}$ and the Vickers hardness HV on the surface of the photoreceptor were controlled to desired values by changing the type and the content ratio of the charge transporting substance and the resin contained in the coating solution for charge transporting layer. The creep value $C_{\mu}$ and the Vickers hardness HV on the surface of the light sensitive bodies of Examples 1 to 3 and Comparative Examples 1 to 5 were measured by a Fisher Scope H100V (manufactured by Fisher Instruments Co.) under the circumstance at a temperature of 25° C. and at a relative humidity of 50%. The measuring conditions included a maximum indentation load: W=30 mN, a necessary time of loading up to the maximum indentation load of 10 sec, a load retention time: t=5 sec and a load removal time of 10 sec.

Each of the light sensitive bodies of Examples 1 to 3 and Comparative Examples 1 to 5 was attached to a copying machine AR-450 having a non-contact charging process (manufactured by Sharp Corp.) which was modified for testing, and an evaluation test for printing resistance and image quality stability was conducted by forming images using a genuine toner for AR-450. Then, the evaluation method for each performance is to be described.

[Printing Resistance]

The pressure of a cleaning blade of a cleaning device provided to the copying machine AR-450 abutting against the photoreceptor, a so-called, cleaning blade pressure was adjusted to 21 gf/cm ($2.06\times10^{-1}$ N/cm) as an initial linear pressure. A character test chart was formed to 100,000 sheets of recording paper on every photoreceptor and a printing resistance test was conducted under a normal temperature/normal humidity (N/N) circumstance at a temperature of 25° C. and at a relative humidity of 50%.

The film thickness, that is, the thickness of the photosensitive layer was measured upon starting the printing resistance test and after forming images to 100,000 sheets of recording paper by a using an instantaneous multi-light measuring system MCPD-1100 (manufactured by Ohtsuka Electronic Co., Ltd.) by light interference method and the film reduction amount of the light sensitive drum was determined based on the difference between the film thickness upon starting the printing resistance test and after forming images for 100,000 sheets of recording paper. As the amount of film reduction was larger it was evaluated that the printing resistance was worse.

[Image Quality Stability]

After forming images for 100,000 sheets of recording paper in the copying machine attached with each of the light sensitive bodies, half-tone images were further formed. By visually observing the half tone images with naked eyes, the unevenness in the density of images was detected, and the level for the lowering of the image quality of the photoreceptor, that is, the stability of image quality was evaluated after the printing resistance test.

The criterion for the evaluation of unevenness in the density is as described below.

A: good. no unevenness in the density of half-tone images

B: level with no practical problem. slight unevenness in the density of half-tone images C: level with practical problem. unevenness in the density of half-tone images Further, overall judgement for the performance of the photoreceptor was also conducted for the amount of film reduction and the unevenness in the density of half-tone images collectively. The evaluation criterion for the overall judgement is as described below.

AA: amount of film reduction of less than 1.0 μm and with no unevenness in the density A: amount of film reduction of 1.0 μm or more and 2.0 μm or less and with no unevenness in the density B: amount of film reduction of greater than 2.0 μm or with slight unevenness in the density C: amount of film reduction of greater than 2.0 μm, and with slight unevenness in the density or with unevenness in the density The results of evaluation are collectively shown in Table 1. In the photoreceptor of the examples of the present invention, that is, the photoreceptor in which the creep value $C_{Ir}$ was 2.70% or more and the Vickers hardness HV was 20 or more and 25 or less, the amount of film reduction was small and the printing resistance was excellent and no unevenness in the density was observed also in the half-tone images after printing test for 100,000 sheets. Particularly, in the light sensitive bodies of Examples 2 and 3 with $C_{Ir}$ of 3.00% or more, the amount of film reduction was extremely small. This is considered to reflect that the photosensitive layers constituting the surface of the light sensitive bodies of Examples 2 and 3 have soft and flexibility of the film represented by the creep property and that the plasticity of the film represented by the Vickers hardness HV has a moderate physical property of neither excessively soft nor exhibiting fragility.

On the other hand, while the light sensitive bodies of Comparative Examples 2 and 3 showed less film reduction amount and excellent printing resistance since $C_{Ir}$ was 3.00% or more, unevenness in the density of images was observed which is considered to be attributable to the degradation of the smoothness on the surface of the photoreceptor. This is assumed that the fragility of the film reflecting on the Vickers hardness HV was developed. Particularly, in Comparative Example 3, since the surface of the photoreceptor was hard, a number of fine scratches were formed along the rotational direction on the surface of the photoreceptor like the surface of an analog record disc by the frictional rubbing of the photoreceptor by the cleaning blade, and degradation of the image quality after the printing resistance test was remarkable.

The light sensitive bodies of Comparative Examples 4 and 5 resulted in extreme increase in the film reduction amount of the photoreceptor. This is considered to be attributable to the decrease of the force-moderating effect against the press contact force of the cleaning blade to the surface of the photoreceptor since the creep value $C_{Ir}$ was small. Further, the smoothness on the surface of the photoreceptor after the printing resistance test was impaired and degradation of images (unevenness in the density) was confirmed although slightly.

Although the details are not apparent for the reason why the unevenness in the density was formed in the light sensitive bodies of Comparative Examples 4 and 5, it may be considered as below. That is, in a case of the photoreceptor of Comparative Example 4, it is considered that the unevenness in the density was formed because the Vickers hardness HV was out of the range of the invention in the direction of increasing the hardness, fragility tending to occur in a hard material was developed to result in uneven wear loss of the film and scatter the exposure laser on the non-smooth surface of the photoreceptor. Further, also for the photoreceptor of Comparative Example 5, unevenness in the density accompanied by the worsening of the surface smoothness was observed like in Comparative Example 4. Although the cause such as loss of structural denseness of the film estimated from the low Vickers hardness HV is considered as the factor for worsening the surface smoothness, details are not apparent.

TABLE 1

| | Physical property value | | Amount of film reduction (μm/100k | Unevenness in density (After printing resistance test for | Overall |
|---|---|---|---|---|---|
| | $C_{Ir}$(%) | HV | Revolutions) | 100,000 sheets) | judgement |
| Example 1 | 2.88 | 20.40 | 1.43 | A | A |
| Example 2 | 3.24 | 23.19 | 0.45 | A | AA |
| Example 3 | 3.10 | 22.70 | 0.82 | A | AA |
| Comp. Example 1 | 2.68 | 21.10 | 2.26 | A | B |
| Comp. Example 2 | 3.35 | 25.23 | 0.53 | B | B |
| Comp. Example 3 | 3.49 | 31.85 | 0.60 | C | C |
| Comp. Example 4 | 2.16 | 26.37 | 2.60 | B | C |
| Comp. Example 5 | 2.13 | 19.00 | 2.80 | B | C |

Figure 6:
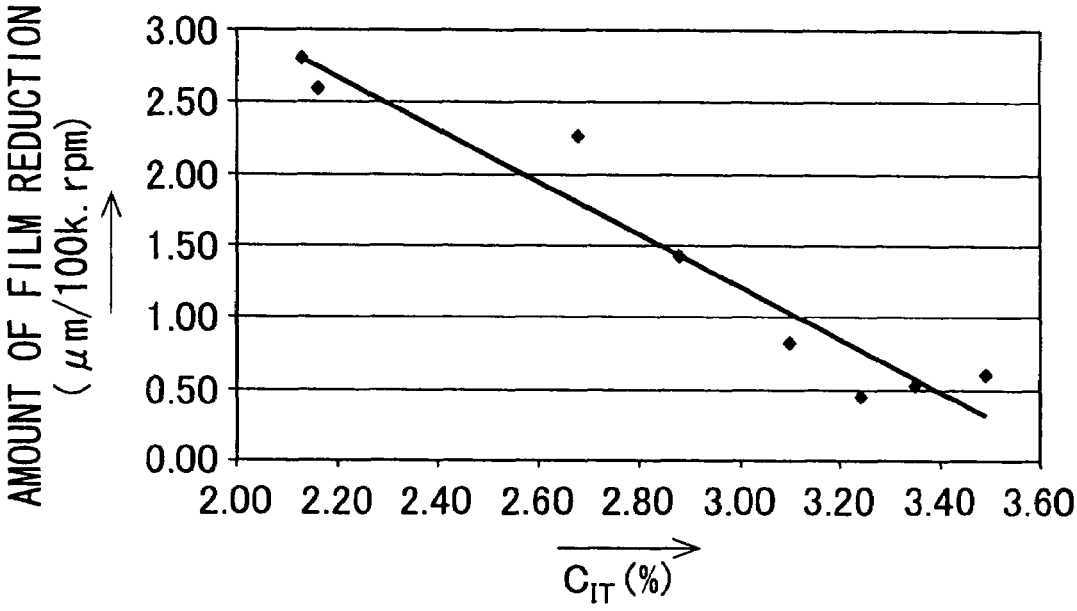
FIG. 6 is a view showing a relation between $C_{Jr}$ and film reduction amount of a photoreceptor.

FIG. 6 is a graph showing a relation between $C_{Ir}$ and film reduction amount of a photoreceptor. FIG. 6 shows a relation between $C_{Ir}$ and film reduction amount measured for the light sensitive bodies of the examples and the comparative examples. It can be seen from FIG. 6 that the amount of film reduction is decreased apparently as $C_{Ir}$ increases. Although details are not apparent, it is considered that the soft and flexibility on the surface of the photoreceptor represented by $C_{Ir}$ characterizes the film reduction amount, that is, the printing resistance by giving an effect on the degree of moderating the pressing force by a cleaning blade exerting on the surface of the photoreceptor.

Further, it is considered that the plasticity on the surface of the photoreceptor represented by the Vickers hardness HV gives an effect on the smoothness of the surface of the photoreceptor along with printing resistance as described above. Accordingly, it is considered that two factors of the creep value $C_{Ir}$ and the Vickers hardness HV have a great concern as the factor determining the printing resistance and the image quality stability of the photoreceptor.

As has been described above, while the surface of the photoreceptor is constituted with a photosensitive layer in this embodiment, this is not restrictive but it may also be constituted such that a surface protective layer is provided further to the outer layer of the photosensitive layer and the creep value CIT and the Vickers hardness HV on the surface of the surface protective layer are set to desired values.

INDUSTRIAL APPLICABILITY

In accordance with the invention, the surface physical property of an electrophotographic photoreceptor used for electrophotographic image formation and charged by a non-contact type charging process is set such that the creep value $C_{Ir}$ is 2.70% or more, preferably, 3.00% or more and a Vickers hardness (HV) at the surface is 20 or more and 25 or less in a case where a maximum indenting load of 30 mN is loaded on the surface under a circumstance at a temperature of 25° C. and at a relative humidity of 50%. This can maintain the soft and flexibility of a film forming surface layer of the electrophotographic photoreceptor and render the plasticity of the film into a suitable state which is neither excessively soft nor fragile. Accordingly, even during long time use where image formation of charging, exposure, development, transfer, cleaning and charge elimination is repeated, since the amount of film reduction is decreased and occurrence of injury to the film is decreased to keep the smoothness on the surface of the photoreceptor, occurrence of injury or unevenness in the density to the formed images can be prevented.

In accordance with the invention, since the electrophotographic photoreceptor excellent in the wear resistance life and scratch resistance is provided, an image forming apparatus not causing injury or unevenness in the density to the formed images is obtained.

The invention claimed is:

1. An electrophotographic photoreceptor in which electrostatic latent images are formed by exposure of a surface charged in a non-contact manner with a light in accordance with image information, toner images are formed by development of the electrostatic latent images, and obstacles including a toner are removed from the surface after the toner images are transferred onto a transfer material, wherein a creep value $C_{J\tau}$ is 2.70% or more and Vickers hardness (HV) at the surface is $20 \leqq HV \leqq 25$ in a case where a maximum indenting load of 30 mN is loaded to the surface under a circumstance at a temperature of 25° C. and at a relative humidity of 50%.

2. The electrophotographic photoreceptor of claim 1, wherein the creep value $C_{J\tau}$is 3.00% or more.

3. An image forming apparatus comprising:

an electrophotographic photoreceptor in which a surface is charged in a non-contact manner and a creep value $C_{J\tau}$ is 2.70% or more in a case where a maximum intending load of 30 mN is loaded to the surface under a circumstance at a temperature of 25° C. and at a relative humidity of 50% and Vickers hardness (HV) at the surface is $20 \leqq HV \leqq 25$, charging means for charging the surface of the electrophotographic photoreceptor in a noncontact manner, exposure means for forming electrostatic latent images by exposure of the charged surface of the electrophotographic photoreceptor by a light in accordance with image information, developing means for developing the electrostatic latent images to form toner images, transfer means for transferring the toner images from the surface of the electrophotographic photoreceptor to a transfer material, and cleaning means for cleaning the surface of the electrophotographic photoreceptor after transfer of the toner images.

4. The image forming apparatus of claim 3, wherein the creep value $C_{J\tau}$ in the electrophotographic photoreceptor is 3.00% or more.

* * * * *